US009328476B1

(12) United States Patent
Langham

(10) Patent No.: US 9,328,476 B1
(45) Date of Patent: May 3, 2016

(54) DOCKING AND MOORING BOAT PROTECTOR

(71) Applicant: Robert M. Langham, Daphne, AL (US)

(72) Inventor: Robert M. Langham, Daphne, AL (US)

( * ) Notice: Subject to any disclaimer, the term of this patent is extended or adjusted under 35 U.S.C. 154(b) by 0 days.

(21) Appl. No.: 14/049,292

(22) Filed: Oct. 9, 2013

Related U.S. Application Data

(60) Provisional application No. 61/868,808, filed on Aug. 22, 2013.

(51) Int. Cl.
*E02B 3/26* (2006.01)
*E02D 5/60* (2006.01)

(52) U.S. Cl.
CPC ..... *E02D 5/60* (2013.01)

(58) Field of Classification Search
USPC ..... 405/212, 215, 216
See application file for complete search history.

(56) References Cited

U.S. PATENT DOCUMENTS

| | | | | |
|---|---|---|---|---|
| D235,986 | S | 7/1975 | Nielsen | |
| 3,975,916 | A * | 8/1976 | Watson | 405/212 |
| 4,653,420 | A * | 3/1987 | Johnson | 114/219 |
| 4,713,129 | A | 12/1987 | Inhofe, Jr. et al. | |
| 4,900,192 | A | 2/1990 | Wood | |
| 4,920,907 | A | 5/1990 | Richter | |
| 4,964,760 | A | 10/1990 | Hartman | |
| 5,018,471 | A * | 5/1991 | Stevens | 405/211 |
| 5,562,364 | A * | 10/1996 | Darder-Alomar | 405/215 |
| 5,701,837 | A | 12/1997 | Harvey | |
| 6,349,661 | B1 | 2/2002 | Dusek | |
| 6,406,221 | B1 * | 6/2002 | Collier | 405/213 |
| 6,823,811 | B1 * | 11/2004 | Drake | 114/219 |
| 7,036,448 | B1 | 5/2006 | Holmes | |
| 2014/0270977 | A1 * | 9/2014 | Goodman | 405/215 |

* cited by examiner

*Primary Examiner* — Tara M. Pinnock
(74) *Attorney, Agent, or Firm* — Robert C. Montgomery; Montgomery Patent & Design LLC

(57) ABSTRACT

A boat protector is provided with padding on a front surface and is adapted to be secured to a piling or similar structure which is anticipated to contact a watercraft by positioning the padded side facing outward and wrapping securing straps around the piling or similar structure. The securing straps are provided with fastening means to adequately secure the protector to the piling or similar structure.

7 Claims, 5 Drawing Sheets

DOCKING AND MOORING BOAT PROTECTOR

RELATED APPLICATIONS

The present invention was first described in and claims the benefit of U.S. Provisional Application No. 61/868,808, filed Aug. 22, 2013, the entire disclosures of which are incorporated herein by reference.

FIELD OF THE INVENTION

The presently disclosed subject matter is directed to a device attachable to a dock piling particularly suited for protecting docking watercraft.

BACKGROUND OF THE INVENTION

It is a common practice to provide physical bumpers on piers, posts, docks, and other cylindrical surfaces where boats are positioned. Such bumpers provide protection for the watercraft against damage when they bump up against such objects. Unfortunately, over time, such bumpers deteriorate or become completely missing, leaving only the bare wood or steel present to contact the boat. In such instances the hard surface of the boat will hit it directly against the hard surface of the pier or dock, resulting in likely damage to the boat that is expensive to fix. Accordingly, there exists a need for means by which portable boat bumper surfaces can be provided, so as to afford protection against boat damage as described above. The development of the present invention fulfills this need.

The invention has a large center section with a plurality of securement straps. In an alternative embodiment, the outer ends of the straps are also provided with a weighting material such as sand to allow the straps to be thrown around the pier piling. The center surface, which actually contacts the watercraft, is provided with extra padding and protection. With the invention in place, watercraft such as small boats, personal water craft, jet skis, and the like, simply bounce off the invention without causing damage to the dock or the watercraft.

Prior art in this field consists of padding and protectors that secure to a side of a boat's hull. Other protector or are hung from a boat by a tethered rope. These provide some protection only is the position of the padding is in line with the piling. Securing the padding to the pilling is a better method to ensure that anything coming into contact with the piling abuts the padding. Piling bumpers do exist but these are permanently secured and are not transportable. The permanent securement aspect posed a disadvantage because often times these bumpers deteriorate. Furthermore, some pilings are not equipped with bumpers at all. A boat owner wants to have accessible a bumper or protector at all times when docking or mooring. It is an object of this invention to provide a means to easily and effectively add a protective bumper to a piling when docking or mooring a boat. It is a further objective of this invention to provide a means to easily transport the bumper device and attach/detach the device to virtually any piling at a user's discretion. It is a further objective of this invention to provide a means to personalize the device so that a user may express his interests while the device is in use.

SUMMARY OF THE INVENTION

The device includes a center vertical padded section and four (4) horizontal strap portions also comprising padding. The center section is elongated and of a general rectangular shape but may comprise of other shapes to fit to various pilings. The straps protrude perpendicularly from the center section and are provided with fasteners at distal ends thereof. The straps are wrapped around a piling and secured onto each other via the fasteners. Once attached, the central section provides the buffer between the boat hull and piling so as to protect the hull from abrasion and impact against the piling. The central section is equipped with extra padding to ensure adequate protection. The straps are also padded but with less padding so as to enable easy manipulation of the straps. The device is encased in a resilient and durable material to resist abrasion. It is envisioned for this casing to come in a variety of colors and with indicia embedded for aesthetics. The device may be used as a semi-permanent barrier or it may be attached and detached each and every time a boat is docked or moored.

An alternative embodiment of the invention incorporates weighted strap portions for situations where a user is unable to adequately reach about the piling to properly secure the straps. In this embodiment, a user throws the weighted strap portions around a piling to catch the strap. The ends of the strap can then be fastened to each other to make a secure fit about the piling.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
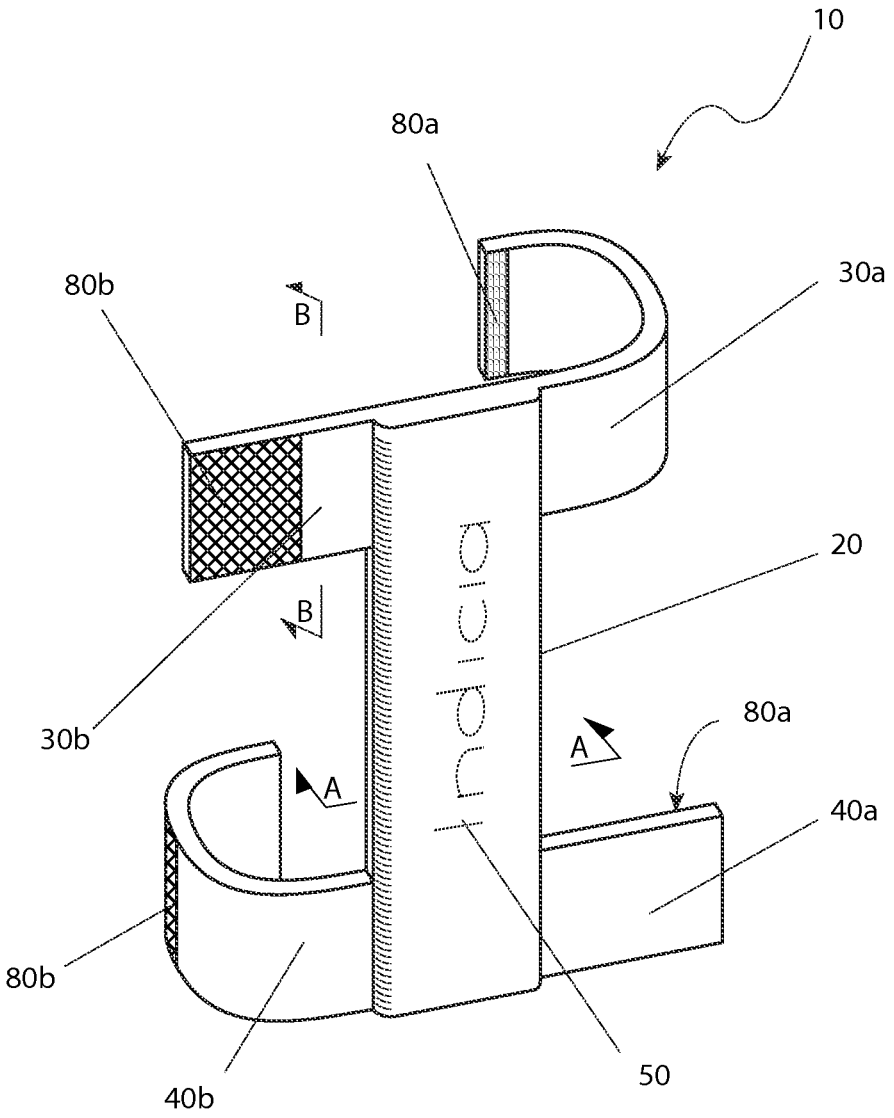
FIG. 1 is a perspective view of a docking and mooring boat protector 10, according to a preferred embodiment of the present invention.

10 boat protector
20 padded section
22 padding
24 cover
30*a* first upper strap
30*b* second upper strap
40*a* first lower strap
40*b* second lower strap
50 indicia
80*a* first fastener
80*b* second fastener
100 piling
105 dock structure

150 weighted strap
152 weight

DETAILED DESCRIPTION OF THE PREFERRED EMBODIMENT

Figure 2:
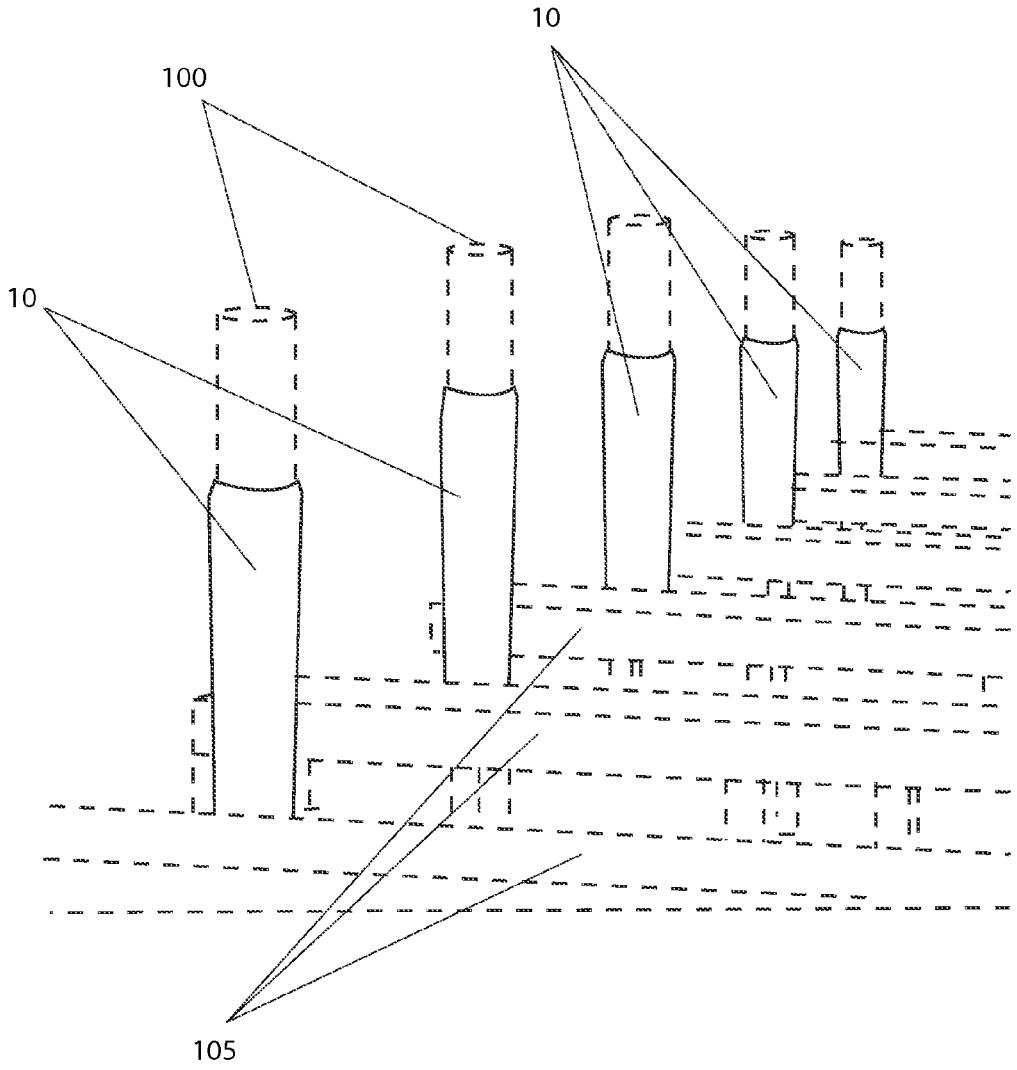
FIG. 2 is an environmental view of the docking and mooring boat protector 10, according to a preferred embodiment of the present invention.
Figure 3A:
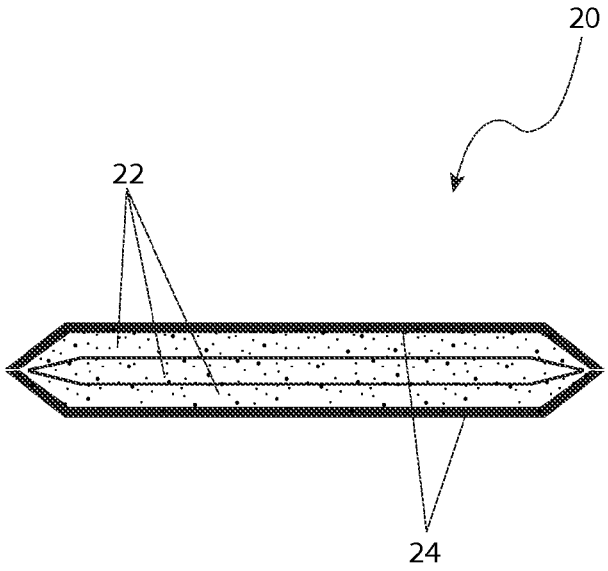
FIG. 3*a* is a sectional view of a pad section 20 of the docking and mooring boat protector 10 along section line A-A (see FIG. 1), according to a preferred embodiment of the present invention.
Figure 3B:
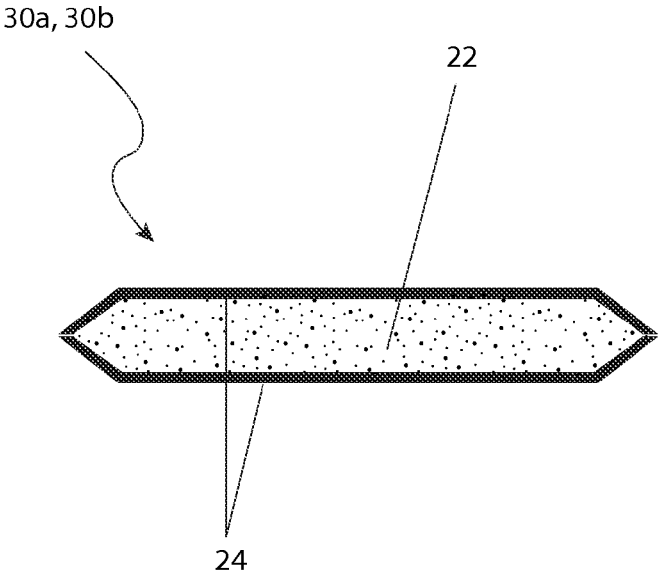
FIG. 3*b* is a sectional view of a second upper strap portion 30*b* of the docking and mooring boat protector 10 along section line B-B (see FIG. 1), according to a preferred embodiment of the present invention.
Figure 4:
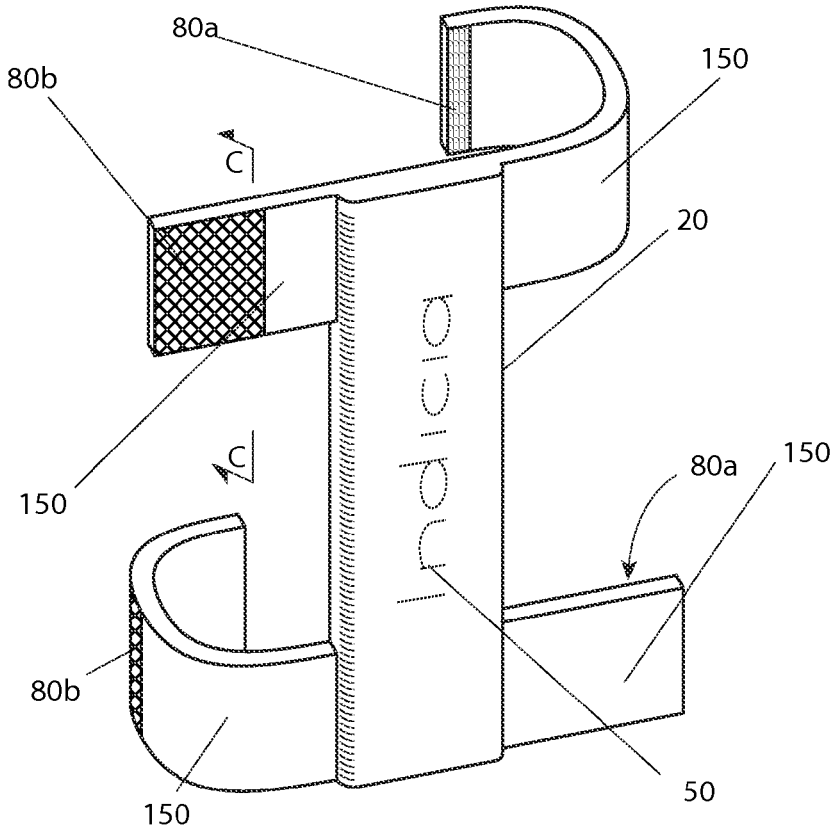
FIG. 4 is an alternate view having a weighted strap portions 150, according to an alternate embodiment of the present invention; and, FIG. 5 is sectional view of a weighted strap portion 150 taken along section line C-C (see FIG. 4), according to an alternate embodiment of the present invention.
Figure 5:
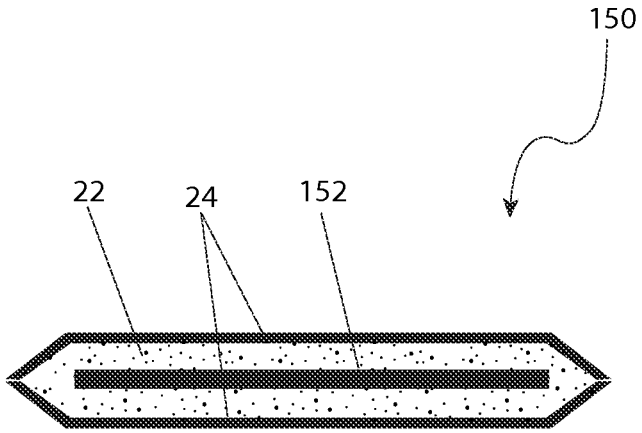

The best mode for carrying out the invention is presented in terms of its preferred embodiment, herein depicted within FIGS. 1 through 3*b*, and in terms of an alternate embodiment, herein depicted in FIGS. 4 and 5. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a boat protector (herein described as the "device") 10, which provides a protective barrier system for installation upon a dock piling portion 100 of a dock structure 105, and other similar features to protect watercraft against scratching and marking while docked.

Referring now to FIG. 1, a perspective view of the device 10, according to a preferred embodiment of the present invention, is disclosed. The device 10 includes a center vertical padded section 20 and four (4) horizontal strap portions 30*a*, 30*b*, 40*a*, 40*b* made up of rubber padding layers 22 being approximately one-half inch (½ in.) thick. The device 10 generally has an overall shape of the letter "I". When laid flat, the device 10 measures approximately thirty-six (36) inches tall by approximately forty inches (40 in.) in width, having the center padded section 20 being approximately thirteen inches (13 in.) in width, thereby providing protection to a variety of differently sized boat hulls. However, it is understood that the device 10 may be introduced in a wide range of sizes which correspond to various round or polygonal-shaped pilings 100 and having various circumferential lengths. Additionally, one (1) embodiment of the device 10 provides weighted strap portions 150 to enable installation upon pilings 100 which a user is unable to reach around (see FIGS. 4 and 5).

The device 10 comprises a pad section 20, a first upper strap 30*a*, a second upper strap 30*b*, a first lower strap 40*a*, and a second lower strap 40*b*. The upper straps 30*a*, 30*b* protrude outward in a perpendicular manner from opposing side edge portions of the center padded section 20 further comprising respective mating first fastener 80*a* and second fastener 80*b* portions having sufficient area to allow selective attachment around pilings 100 having various circumferences. In like manner the lower straps 40*a*, 40*b* extend outwardly from lower side edge portions of the padded section 20 and also comprise respective hook-and-loop fasteners 80*a*, 80*b*. The hook-and-loop fasteners 80*a*, 80*b* are envisioned to be similar to VELCRO® and allow the device 10 to be secured around, and secured to the piling 100.

The device 10 comprises a center padded section 20 having additional padding layers 22 for extra protection (see FIG. 3*a*). The padded section 20 is envisioned to provide various graphic indicia 50 such as sport team logos, college logos, corporate logos, or the like for increased visual appeal.

Referring now to FIG. 2, an environmental view of the device 10, according to a preferred embodiment of the present invention, is disclosed. A plurality of the devices 10 is illustrated here being applied to a plurality of respective piling portions 100 of a dock structure 105. In use, the four (4) extending strap portions 30*a*, 30*b*, 40*a*, 40*b* wrap around the piling 100 and are attached to each other via integral hook-and-loop fasteners 80*a*, 80*b*. The device 10 may be left in place upon piling 100 on a semi-permanent basis, or could be installed and removed each time a watercraft is present at the dock 105. With the device 10 in place, watercraft such as small boats, personal water craft, jet skis, and the like, simply deflect from the device 10 without causing damage to the dock 105 or to the watercraft.

Referring now to FIGS. 3*a* and 3*b*, sectional views of the padded section 20 and the second upper strap 30*b* portions, respectively, according to a preferred embodiment of the present invention, are disclosed. The device 10 comprises at least one (1) thickness of a padding layer 22 made using foamed or solid neoprene rubber sheet or equivalent resilient and durable material, forming the padded section 20 and the straps 30*a*, 30*b*, 40*a*, 40*b*. The straps 30*a*, 30*b*, 40*a*, 40*b* are envisioned to comprise a single padding layer 22 while the center padded section 20 is envisioned to comprises a plurality of bonded padding layers 22 preferably being adhesively bonded together or otherwise joined together to provide extra shock absorption due to anticipated contact with a watercraft, three (3) layers being shown here for illustration sake. The padded section 20 and strap portions 30*a*, 30*b*, 40*a*, 40 are collectively enclosed within a cover 24 also envisioned to be adhesively bonded to the padded layers 22 and sealed along edge portions using common plastic joining methods such as RF welding, heat sealing, and the like. The cover 24 is envisioned to be made of sealed and waterproof materials such as extruded vinyl sheet, a rubberized textile material, or the like. The cover 24 is also envisioned being introduced in various colors and patterns, and having various displayed indicia 50 based upon a user's preference.

Referring now to FIGS. 4 and 5, perspective and sectional views of an alternate weighted strap embodiment 150 of the present invention, are disclosed. It is envisioned that another embodiment of the device 10 providing similar construction and external appearance may comprise alternate weighted strap portions 150 having internal weights 152 embedded within the padding layer 22. Said weights 152 are envisioned to be made using materials such as sand, metal shot, metal plates, or the like, to allow said straps 150 to be thrown around the piling 100 and caught by a user when being installed upon pilings 100 being awkwardly positioned or being too large to reach around.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 2, or alternately in FIG. 4.

The method of installing and utilizing the device 10 may be achieved by performing the following steps: procuring at least one (1) device 10 having a desired color and indicia 50; positioning a rear surface of the padded section 20 against a portion of a piling 100 or similar structure which is anticipated to contact a watercraft; connecting the upper straps 30*a*, 30*b* tightly around said piling 100 by attaching the hook-and-loop fasteners 80*a*, 80*b*; connecting the lower straps 40*a*, 40*b* tightly around said piling 100 by attaching the hook-and-loop fasteners 80*a*, 80*b*; installing any additional units of the device 10 upon other pilings 100 based upon a particular watercraft and dock structure 105; and, benefiting from protection of one's watercraft from scratching, scraping, and other possible damage resulting from contact with a dock structure 105, afforded a user of the present invention 10.

An alternate embodiment of the present invention 10 comprises weighted strap portions 150 having embedded weights 152. The weighted straps 150 would be especially useful in an event that the device 10 is being installed upon large piling 100 which is impossible for the user to reach around. The weighted embodiment 150 may be installed by the user by throwing the weighted strap portions 150 around the piling 100 and subsequently catching said weighted straps 150, and attaching the fastener portions 80*a*, 80*b* tightly around said piling 100.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A watercraft protector, comprising:

a shock-absorbing center padded section, comprising a padding layer;

a plurality of weighted straps, each protruding outwardly from a perimeter edge portion of said center padded section, comprising said padding layer;

a fastening means located at ends of each opposing pairs; and, a cover encompassing said center padded section and said plurality of weighted straps;

wherein said protector is adapted for installation upon a dock piling of a dock structure such that said protector is capable of absorbing an impact from a watercraft to protect said watercraft from damage thereto;

wherein said plurality of weighted straps are provided in pairs extending outwardly from opposing sides of said center padded section;

wherein said plurality of weighted straps further comprises at least one weighted object embedded within said padded layer; and, wherein said fastening means is capable of securing said protector to said dock piling.

2. The protector of claim 1, wherein said protector comprises a general I-shape.

3. The protector of claim 1, wherein said center padded section further comprises additional padding layers each bonded together.

4. The protector of claim 3, further comprising a length of approximately thirty-six inches and a width of approximately forty inches.

5. The protector of claim 4, wherein said center padded section is approximately thirteen inches in width.

6. The protector of claim 1, further comprising a length of approximately thirty-six inches and a width of approximately forty inches.

7. The protector of claim 6, wherein said center padded section is approximately thirteen inches in width.

* * * * *